US006796394B1

(12) United States Patent
Lin

(10) Patent No.: US 6,796,394 B1
(45) Date of Patent: Sep. 28, 2004

(54) SKATEBOARD WITH A POWER DRIVING UNIT

(76) Inventor: Shen-Keng Lin, 387-16, Fan-Hua Rd., Hsiao-Shiu Hsiang, Changhua Hsien (TW)

( * ) Notice: Subject to any disclaimer, the term of this patent is extended or adjusted under 35 U.S.C. 154(b) by 0 days.

(21) Appl. No.: 10/444,551

(22) Filed: May 23, 2003

(51) Int. Cl.[7] ..... A63C 3/00
(52) U.S. Cl. ..... 180/181; 180/180; 280/87.042
(58) Field of Search ..... 180/181, 180, 180/279, 272, 284, 65.1; 280/87.041, 87.042, 11.19, 11.27, 11.28

(56) References Cited

U.S. PATENT DOCUMENTS 4,073,356 A * 2/1978 Schlicht ..... 180/181
5,330,026 A * 7/1994 Hsu et al. ..... 180/181
5,381,870 A * 1/1995 Kaufman ..... 180/181
5,487,441 A * 1/1996 Endo et al. ..... 180/181
5,927,420 A * 7/1999 Karrington ..... 180/181
5,950,754 A * 9/1999 Ondrish, Jr. ..... 180/181
6,050,357 A * 4/2000 Staelin et al. ..... 180/65.1
6,604,593 B1 * 8/2003 Mullet ..... 180/181
2002/0074176 A1 * 6/2002 Justus et al. ..... 180/181
2004/0021281 A1 * 2/2004 Stephens ..... 280/87.042
2004/0065494 A1 * 4/2004 Nelson ..... 180/181

* cited by examiner

*Primary Examiner*—Christopher P. Ellis
*Assistant Examiner*—J. Allen Shriver
(74) *Attorney, Agent, or Firm*—Brooks Kushman P.C.

(57) ABSTRACT

A skateboard includes a board member, a front roller, a rear roller, a pair of left and right intermediate rollers disposed between the front and rear rollers, and a driving unit for driving the left and right intermediate rollers. A control unit is operable among a first mode, in which the driving unit is activated to drive the left and right intermediate rollers, a second mode, in which the driving unit is deactivated, a third mode, in which the driving unit is activated to drive one of the left and right intermediate rollers, and a fourth mode, in which the driving unit is activated to drive the other one of the left and right intermediate rollers.

3 Claims, 8 Drawing Sheets

SKATEBOARD WITH A POWER DRIVING UNIT

BACKGROUND OF THE INVENTION

1. Field of the Invention

The present invention relates to a skateboard, more particularly to a skateboard with a power driving unit.

2. Description of the Related Art

A conventional skateboard generally includes a board member, a pair of front rollers mounted rotatably to a bottom surface of the board member, and a pair of rear rollers mounted rotatably to the bottom surface of the board member and spaced apart from the front rollers.

Since the conventional skateboard is propelled by the legs of the rider, it is relatively tiresome.

SUMMARY OF THE INVENTION

Therefore, the object of this invention is to provide a skateboard with a power driving unit so as to overcome the aforesaid disadvantage of the prior art.

According to the present invention, a skateboard includes: a board member having opposite top and bottom surfaces, and front and rear ends; a front roller mounted rotatably on the bottom surface of the board member and disposed adjacent to the front end of the board member; a rear roller mounted rotatably on the bottom surface of the board member, disposed adjacent to the rear end of the board member, and each having a diameter less than that of the front roller; a pair of opposing left and right intermediate rollers mounted rotatably on the bottom surface of the board member between the front and rear rollers, and having a diameter the same as that of the front roller; first and second transmission units connected respectively to the left and right intermediate rollers; a power driving unit connected to the first and second transmission units; and a control unit mounted on the top surface of the board member, and electrically connected to the driving unit so as to be operable among a first mode, in which the driving unit is activated to drive the left and right intermediate rollers through the first and second transmission units, a second mode, in which the driving unit is deactivated, a third mode, in which the driving unit is activated to drive one of the left and right intermediate rollers through the first transmission unit, and a-fourth mode, in which the driving unit is activated to drive the other one of the left and right intermediate rollers through the second transmission unit.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
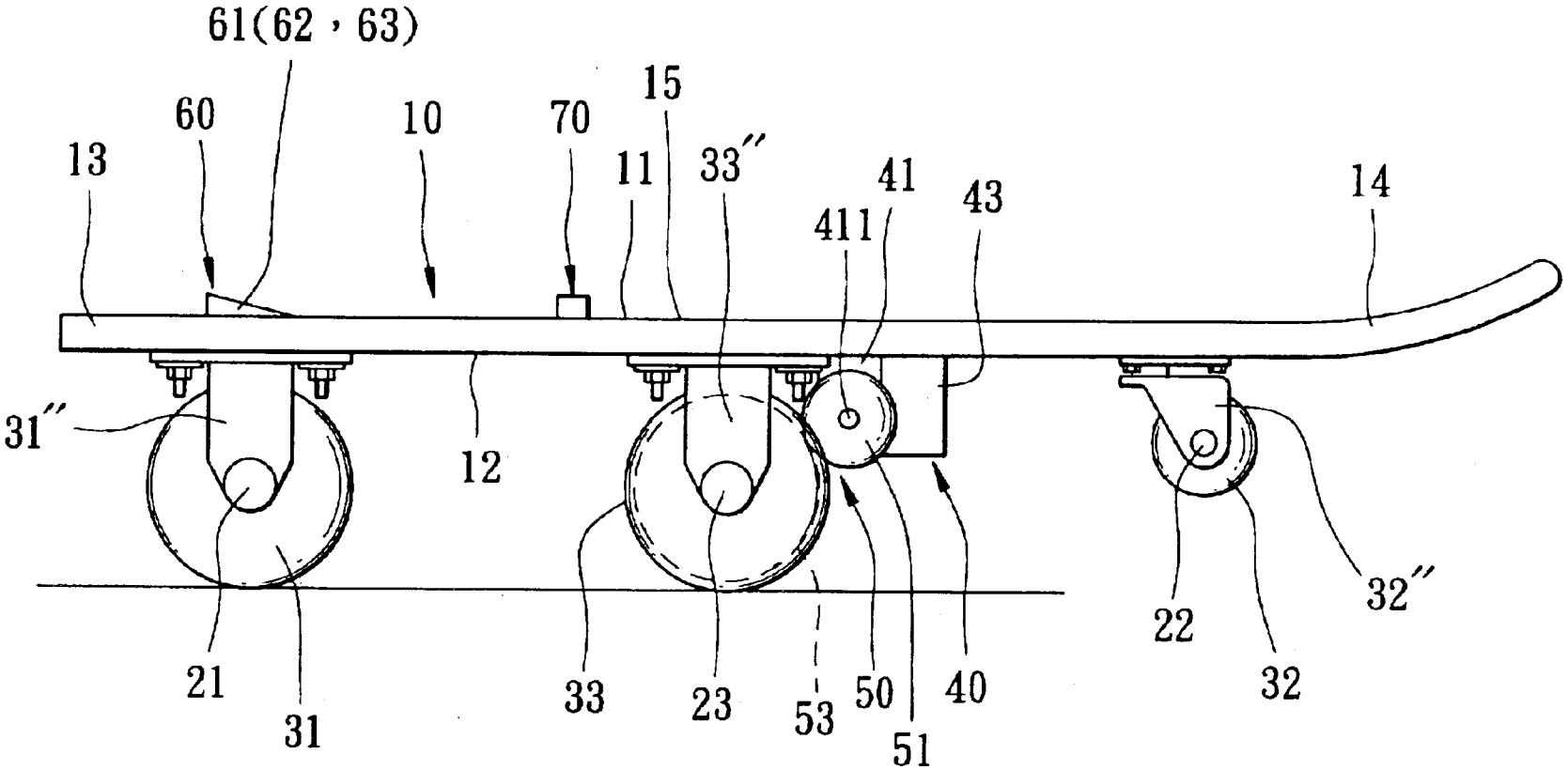
FIG. 1 is a schematic side view of the preferred embodiment of a skateboard according to the present invention.
Figure 2:
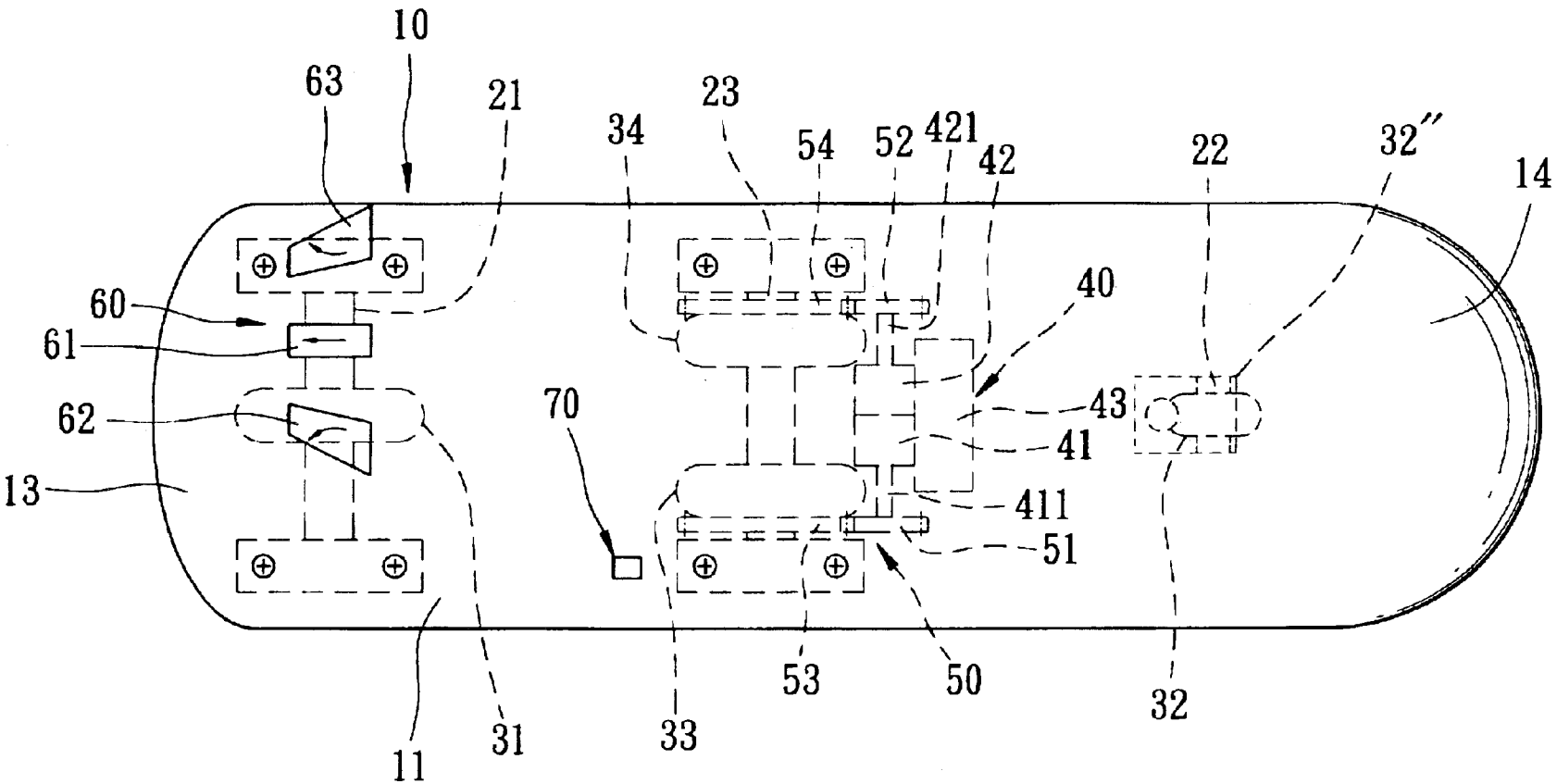
FIG. 2 is a top planar view of the preferred embodiment.

Referring to FIGS. 1 to 4, the preferred embodiment of a skateboard according to the present invention is shown to include a board member 10, a front roller 31, a first axle 21, a rear roller 32, a second axle 22, a pair of left and right intermediate rollers 33,34, a third axle 23, first and second transmission units 50, a power driving unit 40, and a control unit 60.

As illustrated, the board member 10 has opposite top and bottom surfaces 11,12, and front and rear ends 13,14. The bottom surface 12 of the board member 10 is provided with first, second and third brackets 31",32",33". The second bracket 32" is rotatable about a vertical axis relative to the board member 10.

The front roller 31 is mounted rotatably on the first bracket 31" through the first axle 21, which extends through the first bracket 31", and is disposed adjacent to the front end 13 of the board member 10.

The rear roller 32 is mounted rotatably on the second bracket 32" through the second axle 22, which extends through the second bracket 32", and is disposed adjacent to the rear end 14 of the board member 10. The rear roller 32 has a diameter less than that of the front roller 31.

The left and right intermediate rollers 33,34 are mounted on the third bracket 33" through the third axle 23, which extends through the third brackets 33", and are disposed between the front and rear rollers 31,32. Each of the left and right intermediate rollers 33,34 has a diameter the same as that of the front roller 31.

The first and second transmission units 50 are connected respectively to the left and right intermediate rollers 33,34.

The driving unit 40 is connected to the first and second transmission units 50. Preferably, a power source 43, such as a battery, is electrically connected to the driving unit 40.

The control unit 60 is mounted on the top surface 11 of the board member 10, and is electrically connected to the driving unit 40. The control unit 60 is operable among a first mode, in which the driving unit 40 is activated to drive the left and right intermediate rollers 33,34 through the first and second transmission units 50, a second mode, in which the driving unit 40 is deactivated, a third mode, in which the driving unit 40 is activated to drive one of the left and right intermediate rollers 33,34 through the first transmission unit 50, and a fourth mode, in which the driving unit 40 is activated to drive the other one of the left and right intermediate rollers 33,34 through the second transmission unit 50.

In this preferred embodiment, the driving unit 40 includes first and second driving motors 41,42 that are disposed adjacent to the left and right intermediate rollers 33,34, respectively, and that have first and second output shafts 411,421, respectively. A rotation-controlling switch 70 is mounted on the top surface 11 of the board member 10, and is electrically connected to the driving unit 40 so as to control rotating direction of the first and second output shafts 411,421. Each of the first and second transmission units 50 has a driving gear 51 (52) fixed coaxially to a respective one of the first and second output shafts 411,421, and a driven gear 53 (54) co-axially fixed to a respective one of the left and right intermediate rollers 33,34, and meshed with the driving gear 51 (52).

Figure 3:
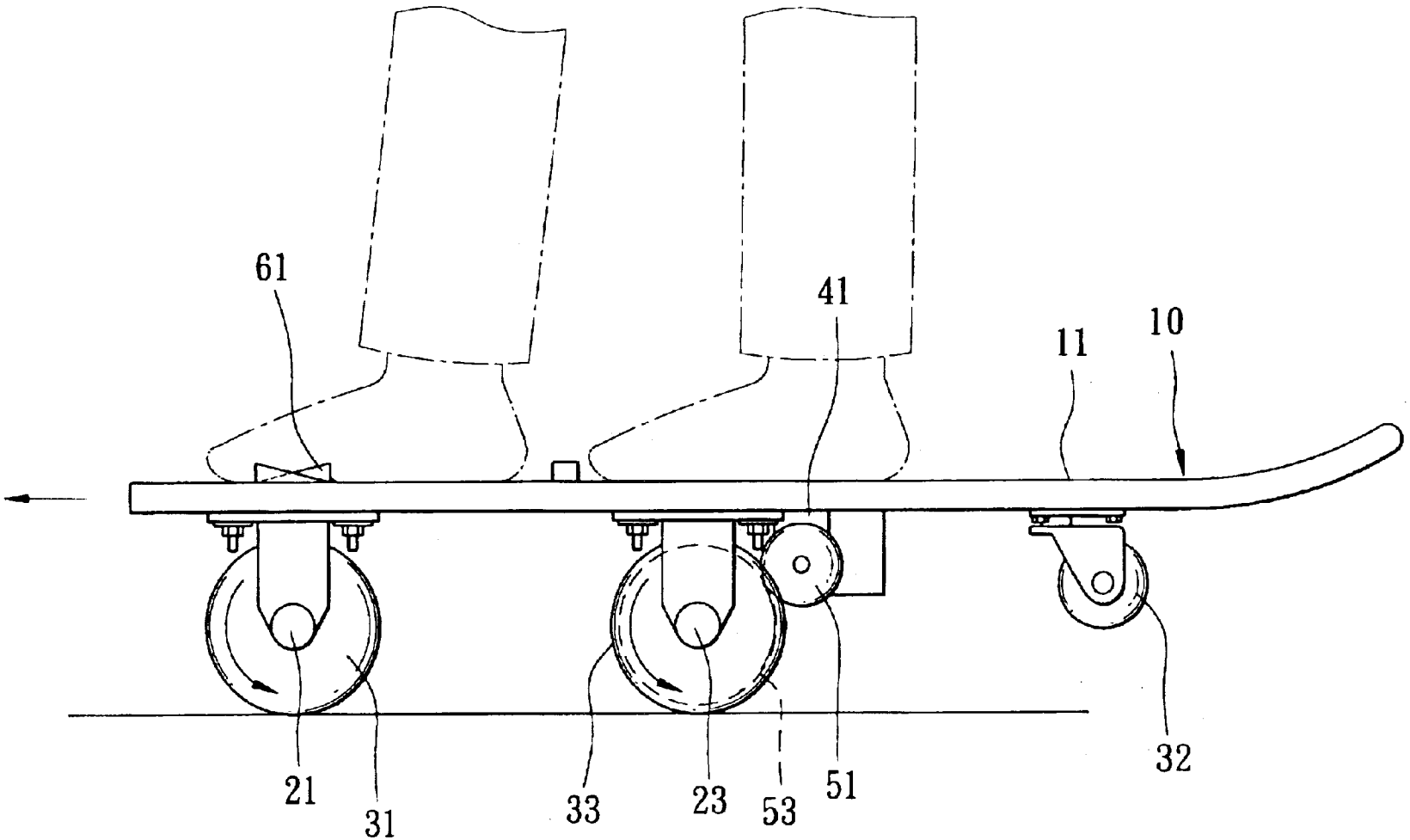
FIG. 3 is a schematic side view of the preferred embodiment, illustrating how a rider stands on the skateboard in order to move the same in a forward direction.
Figure 4:
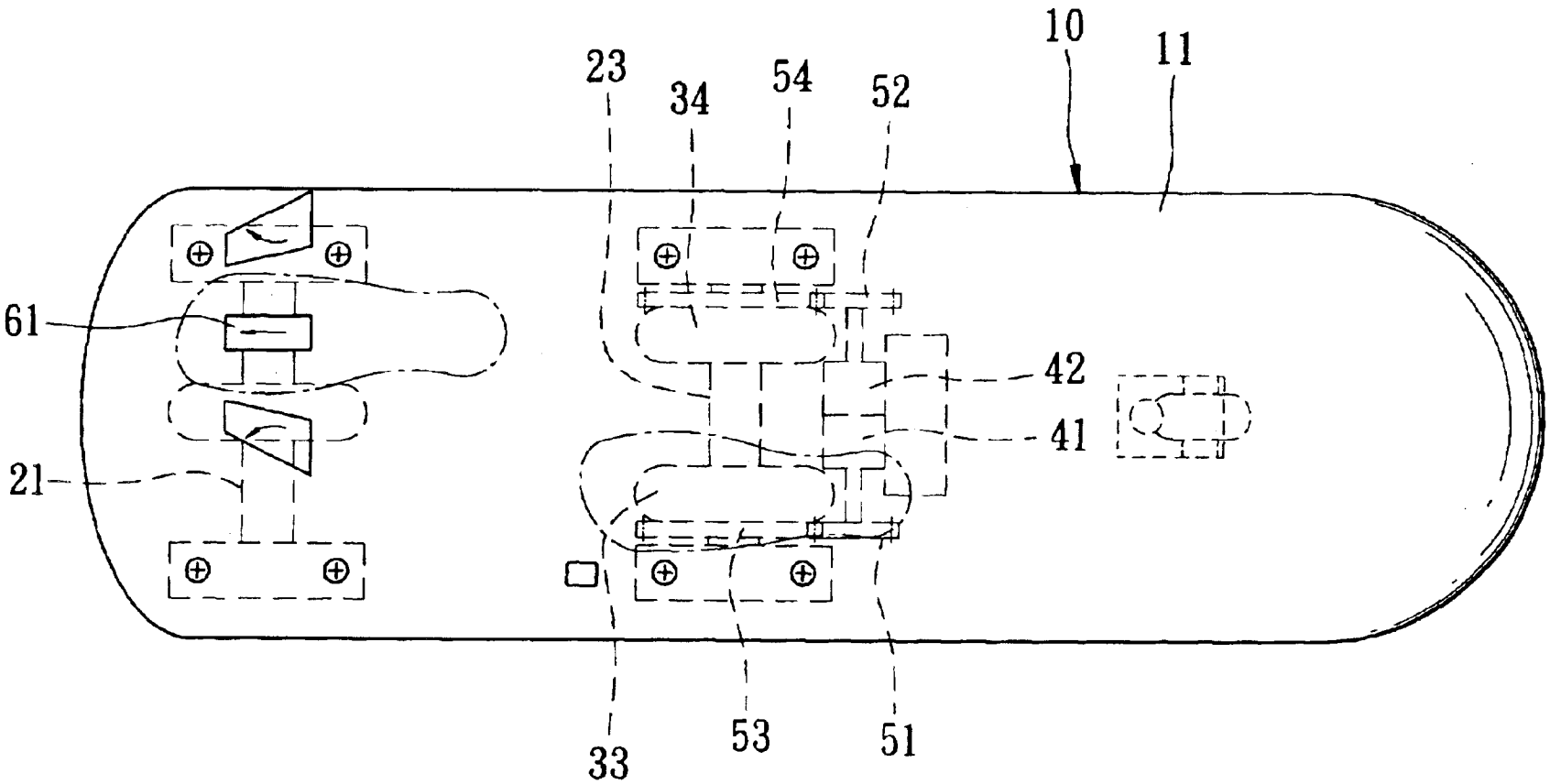
FIG. 4 is a top planar view of the preferred embodiment, illustrating how the rider stands on the skateboard in order to move the same in the forward direction.
Figure 5:
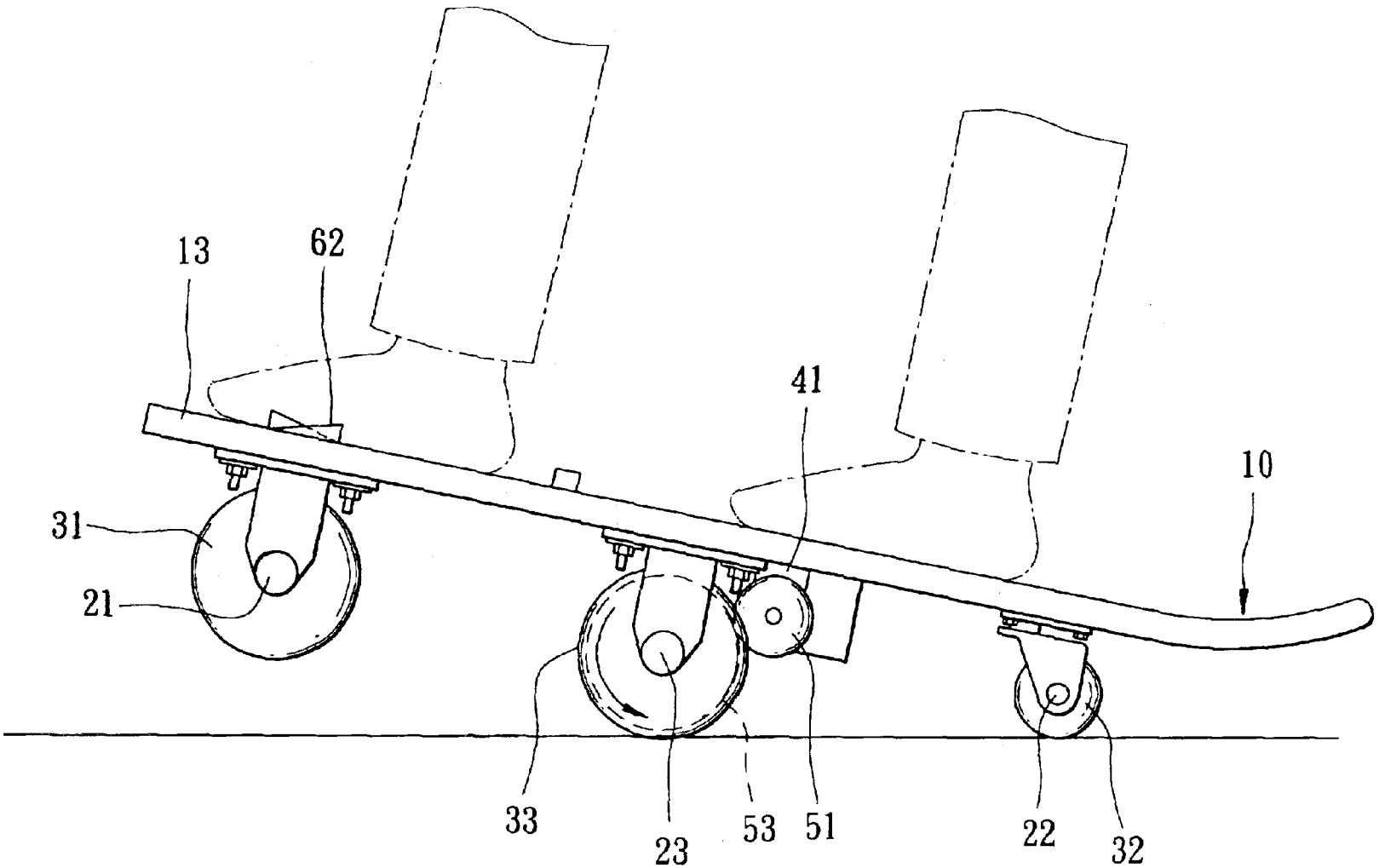
FIG. 5 is a schematic side view of the preferred embodiment, illustrating how the skateboard is tilted upward in order to turn the same to the left.
Figure 6:
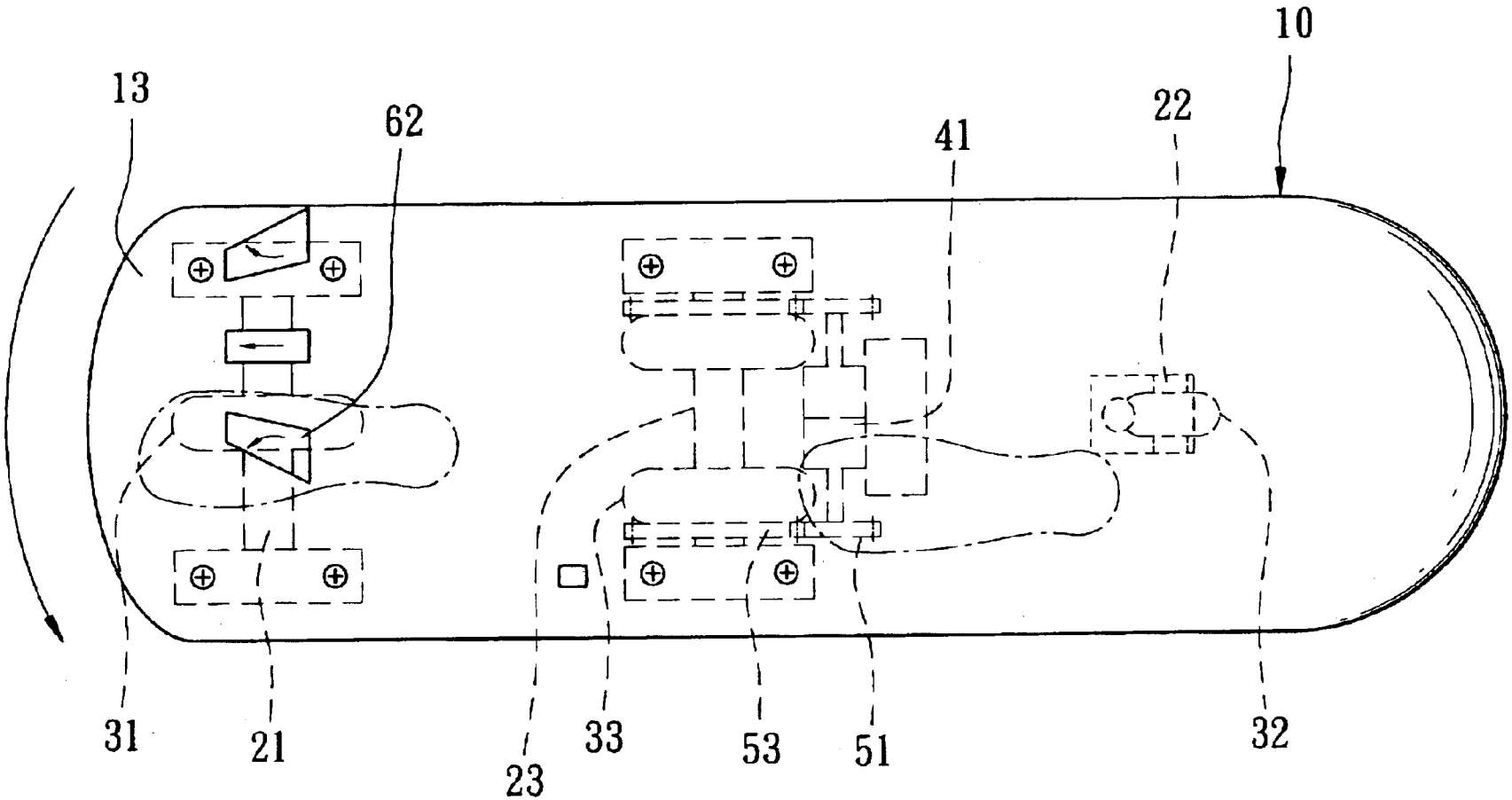
FIG. 6 is a top planer view of the preferred embodiment, illustrating how the rider stands on the skateboard in order to turn the same to the left.
Figure 7:
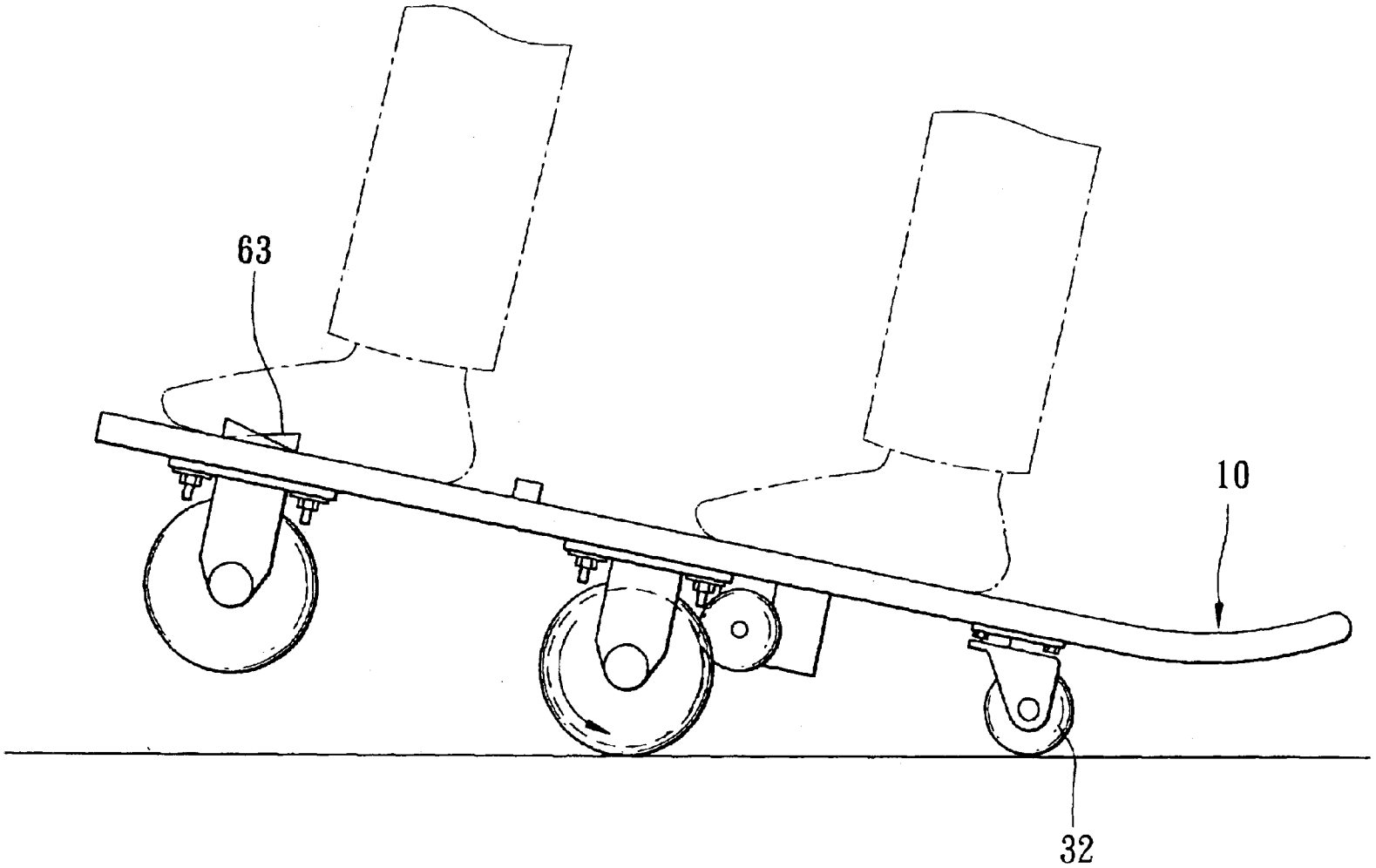
FIG. 7 is a schematic side view of the preferred embodiment, illustrating how the skateboard is tilted upward in order to turn the same to the right.
Figure 8:
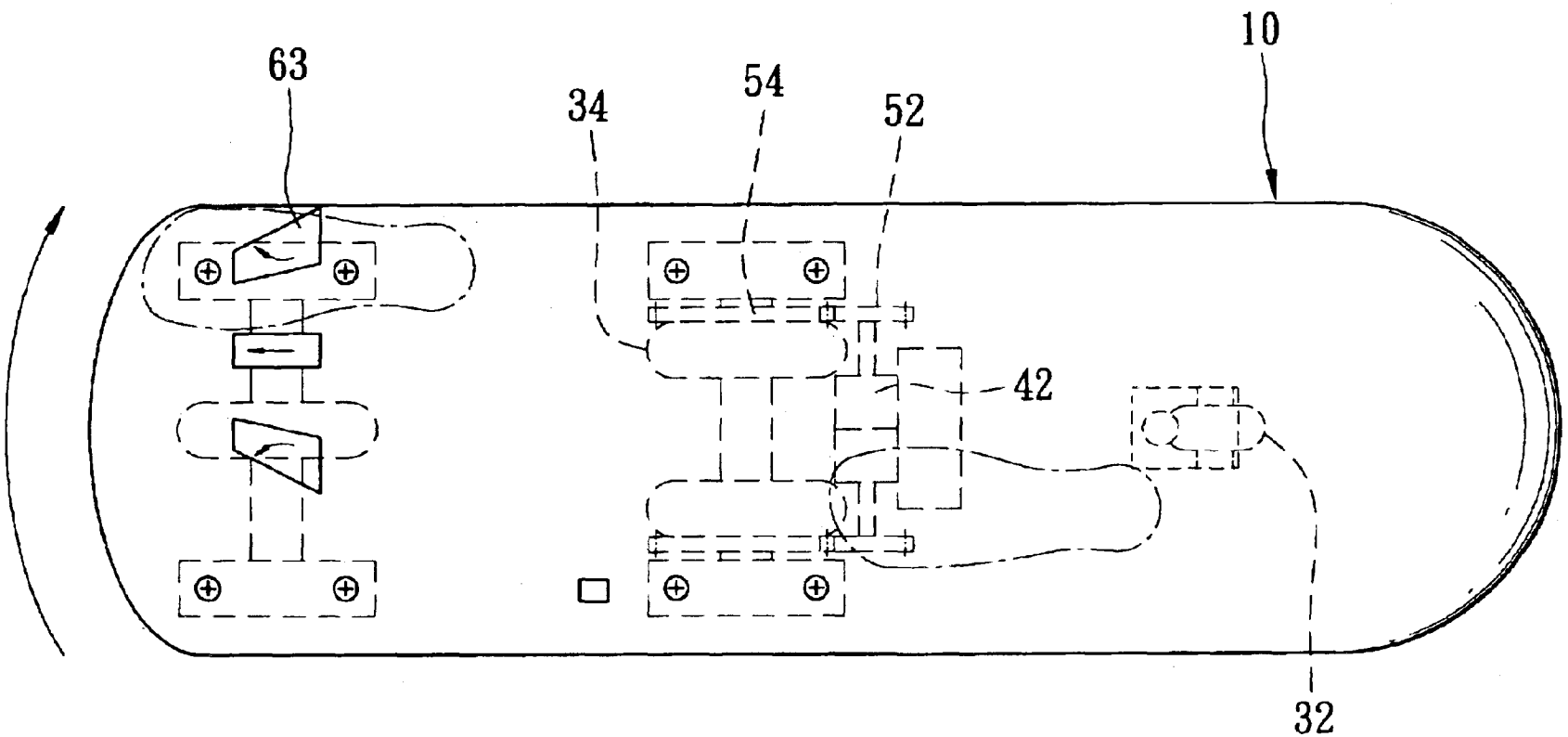
FIG. 8 is a top planer view of the preferred embodiment, illustrating how the rider stands on the skateboard in order to turn the same to the right.

The control unit 60 preferably includes a first switch 61, a second switch 62 and a third switch 63. The first switch 61 is operable by the rider's foot so as to permit operation of the control unit 60 between the first and second modes. Similarly, the second switch 62 is operable by the rider's foot so as to permit operation of the control unit 60 between the third and second modes. The third switch 63 is operable by the rider's foot so as to permit operation of the control unit 60 between the fourth and second modes. When it is desired to propel the skateboard to move in a straight direction, the first switch 61 is pressed by the rider's right foot, as best shown in FIGS. 3 and 4, so as to dispose the control unit 60 in the first mode. The skateboard can be stopped from moving in the straight direction by simply releasing the first switch 61. When it is desired to make a left turn, the second switch 62 is pressed by the rider's right foot (see FIG. 6) to dispose the control unit 60 in the third mode, and the skateboard is tilted such that the rear roller 32 contacts the ground surface to serve as a pivot for left turning of the skateboard, as best shown in FIG. 5. The leftwise turning can be stopped by simply releasing the second switch 62. When it is desired to make a right turn, the third switch 63 is pressed by the rider's right foot (see FIG. 8) to dispose the control unit 60 in the fourth mode, and the skateboard is tilted such that the rear roller 32 contacts the ground surface to serve as a pivot for right turning of the skateboard, as best shown in FIG. 7. The rightwise turning can be stopped by simply releasing the third switch 63.

With the inclusion of the driving unit 40, the transmission unit So and the control unit 60 in the skateboard of the present invention, the aforementioned disadvantage of the prior art can be overcome.

With this invention thus explained, it is apparent that numerous modifications and variations can be made without departing from the scope and spirit of this invention. It is therefore intended that the invention be limited only as indicated in the appended claims.

I claim:

1. A skateboard comprising:

a board member having opposite top and bottom surfaces, and front and rear ends;

a front roller mounted rotatably on said bottom surface of said board member, and disposed adjacent to said front end of said board member;

a rear roller mounted rotatably on said bottom surface of said board member, disposed adjacent to said rear end of said board member, and having a diameter less than that of said front roller;

left and right intermediate rollers mounted rotatably on said bottom surface of said board member between said front and rear rollers, and each having a diameter the same as that of said front roller;

first and second transmission units connected respectively to said left and right intermediate rollers;

a power driving unit connected to said first and second transmission units; and a control unit mounted on said top surface of said board member, and electrically connected to said driving unit so as to be operable among a first mode, in which said driving unit is activated to drive said left and right intermediate rollers through said first and second transmission units, a second mode, in which said driving unit is deactivated, a third mode, in which said driving unit is activated to drive one of said left and right intermediate rollers through said first transmission unit, and a fourth mode, in which said driving unit is activated to drive the other one of said left and right intermediate rollers through said second transmission unit.

2. The skateboard as defined in claim 1, wherein said driving unit includes first and second driving motors disposed respectively adjacent to said left and right intermediate rollers, and respectively having first and second output shafts, each of said first and second transmission units having a driving gear fixed coaxially on a respective one of said first and second output shafts, and a driven gear co-axially fixed on each of said left and right intermediate rollers and meshed with said driving gear.

3. The skateboard as defined in claim 2, wherein said control unit includes a first switch operable to permit operation of said control unit between said first and second modes, a second switch operable to permit operation of said control unit between said fourth and second modes, and a third switch operable to permit operation of said control unit between said third and second modes.

* * * * *